US009154871B2

(12) United States Patent
Akino

(10) Patent No.: US 9,154,871 B2
(45) Date of Patent: Oct. 6, 2015

(54) CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 218 days.

(21) Appl. No.: 13/926,018

(22) Filed: Jun. 25, 2013

(65) Prior Publication Data

US 2014/0003628 A1 Jan. 2, 2014

(30) Foreign Application Priority Data

Jul. 2, 2012 (JP) ..... 2012-148150

(51) Int. Cl.
*H04R 3/00* (2006.01)
*H04R 19/04* (2006.01)
*H04R 27/00* (2006.01)

(52) U.S. Cl.
CPC ..... *H04R 3/00* (2013.01); *H04R 19/04* (2013.01); *H04R 27/00* (2013.01)

(58) Field of Classification Search
None
See application file for complete search history.

(56) References Cited

U.S. PATENT DOCUMENTS

| | | | | |
|---|---|---|---|---|
| 2008/0130935 | A1* | 6/2008 | Sato et al. | 381/361 |
| 2008/0159578 | A1* | 7/2008 | Akino et al. | 381/361 |
| 2008/0310663 | A1* | 12/2008 | Shirasaka et al. | 381/355 |
| 2011/0007925 | A1* | 1/2011 | Akino | 381/369 |
| 2011/0142264 | A1* | 6/2011 | Akino | 381/174 |

FOREIGN PATENT DOCUMENTS

JP 2011-009807 1/2011

* cited by examiner

*Primary Examiner* — Paul Huber
(74) *Attorney, Agent, or Firm* — Whitham Curtis Christofferson & Cook, PC

(57) ABSTRACT

A condenser microphone includes a volume restrictor disposed in a space inside a microphone case and an electronic circuit disposed in the space and encompassed by the volume restrictor. The volume restrictor reduces the volume of the space and prevents sound waves entering the space through openings on the microphone case from reaching the electronic circuit.

9 Claims, 2 Drawing Sheets

CONDENSER MICROPHONE

TECHNICAL FIELD

The present invention relates to a condenser microphone that can prevent vibration of an electronic circuit even under high acoustic pressure and provide excellent frequency response and high-quality audio signals without incidental noise.

BACKGROUND ART

Microphones have been known that are used under high acoustic pressure near musical instruments to acquire sounds of the instruments. Condenser microphones are commonly employed for use near instruments, which can be more easily downsized than dynamic microphones so as not to obstruct the performer's action or view. Sounds of instruments acquired by the microphone are often subjected to amplification (also referred to as "PA (Public Address)") at a concert hall, for example. Such sounds have unidirectionality in general. A unidirectional condenser microphone includes a microphone case having openings on its side wall, the openings communicating with a rear acoustic terminal provided at a condenser microphone unit. The openings introduce sound waves to the rear acoustic terminal of the condenser microphone unit.

A condenser microphone requires an electronic circuit such as an impedance converter for reducing the output impedance of the microphone unit. In this respect, the condenser microphone differs from a dynamic microphone outputting signals from the both ends of a voice coil. The condenser microphone requires an electronic circuit as described above, and should be as small as possible. The condenser microphone therefore includes a circuit board having an electronic circuit thereon near the rear acoustic terminal of the microphone unit.

When such a condenser microphone is used near instruments, for example, sound waves with high acoustic pressure entering the microphone case cause vibration of the circuit board. The vibration of the electronic circuit mounted on the circuit board induces incidental noise other than intended sounds to be electro-acoustically converted by the microphone unit. Such incidental noise results in deterioration in sound quality. Thus, a solution to prevent the electronic circuit from vibrating in response to sound waves has been desired.

The microphone case has an internal space communicating with the openings of the microphone case and located behind the rear acoustic terminal of the microphone unit. The space accommodates the circuit board having the electronic circuit. Since the space serves as acoustic capacitance, the acoustic mass of the space and the openings of the microphone case generate resonance, which deteriorates the frequency response of the microphone. If the space has a large volume, the space could easily accommodate the circuit board and the electronic circuit elements thereof; however, the lowered impedance of the acoustic capacitance makes resonance more likely to occur in the main frequency range of acquired sounds.

A reduction in volume of the space should therefore increase the impedance of the acoustic capacitance. The reduced volume of the space leads to an increase in the impedance of the acoustic capacitance, thereby increasing the resonance frequency of the space. Thus, for a resonance frequency of the space higher than the upper limit of the main frequency range of acquired sounds, the directional frequency response does not deteriorate in a frequency range equal to or lower than the resonance frequency.

A known condenser microphone includes a space behind a rear acoustic terminal of a condenser microphone unit inside a microphone case, and further includes a filler functioning as acoustic resistance in the space to prevent the resonance of the space. In the condenser microphone disclosed in Japanese Unexamined Patent Application Publication No. 2011-9807, a filler is a sintered plastic material having countless continuous pores and disposed in the space inside the microphone case. The filler functions as acoustic resistance against sound waves entering the space through openings on the side wall of the microphone case, and prevents the resonance of the space.

The invention according to Japanese Unexamined Patent Application Publication No. 2011-9807 certainly prevents the resonance of the space inside the microphone case. However, the invention according to Japanese Unexamined Patent Application Publication No. 2011-9807 does not intend to include an electronic circuit in such a small space inside the microphone case, and also not intend to prevent the electronic circuit from vibrating in response to sound waves entering the microphone case.

An object of the present invention is to provide a condenser microphone that includes a space inside a microphone case for accommodating an electronic circuit with a reduced volume to prevent the resonance of the space, and can prevent the electronic circuit from vibrating in response to sound waves.

SUMMARY OF INVENTION

A microphone according to the present invention includes:

- a condenser microphone unit including a rear acoustic terminal;
- a microphone case accommodating the condenser microphone unit, the microphone case having a space therein, the space communicating with the rear acoustic terminal, the microphone case having openings on the side wall of the microphone case, the openings communicating with the space;
- a volume restrictor disposed in the space; and
- an electronic circuit disposed in the space and encompassed by the volume restrictor, wherein
- the volume restrictor reduces the volume of the space and prevents sound waves entering the space through the openings from reaching the electronic circuit.

According to the present invention, the space inside the microphone case communicating with the rear acoustic terminal of the condenser microphone unit and the openings of the microphone case has a volume reduced by the volume restrictor and therefore does not resonate, so that the microphone shows excellent frequency response characteristics. Sound waves with high acoustic pressure entering the microphone case are blocked by the volume restrictor from the electronic circuit. This eliminates incidental noise caused by vibration of the electronic circuit elements.

DESCRIPTION OF EMBODIMENTS

A condenser microphone according to an embodiment of the present invention will be described below with reference to FIGS. 1 and 2.

Embodiment

Figure 1:
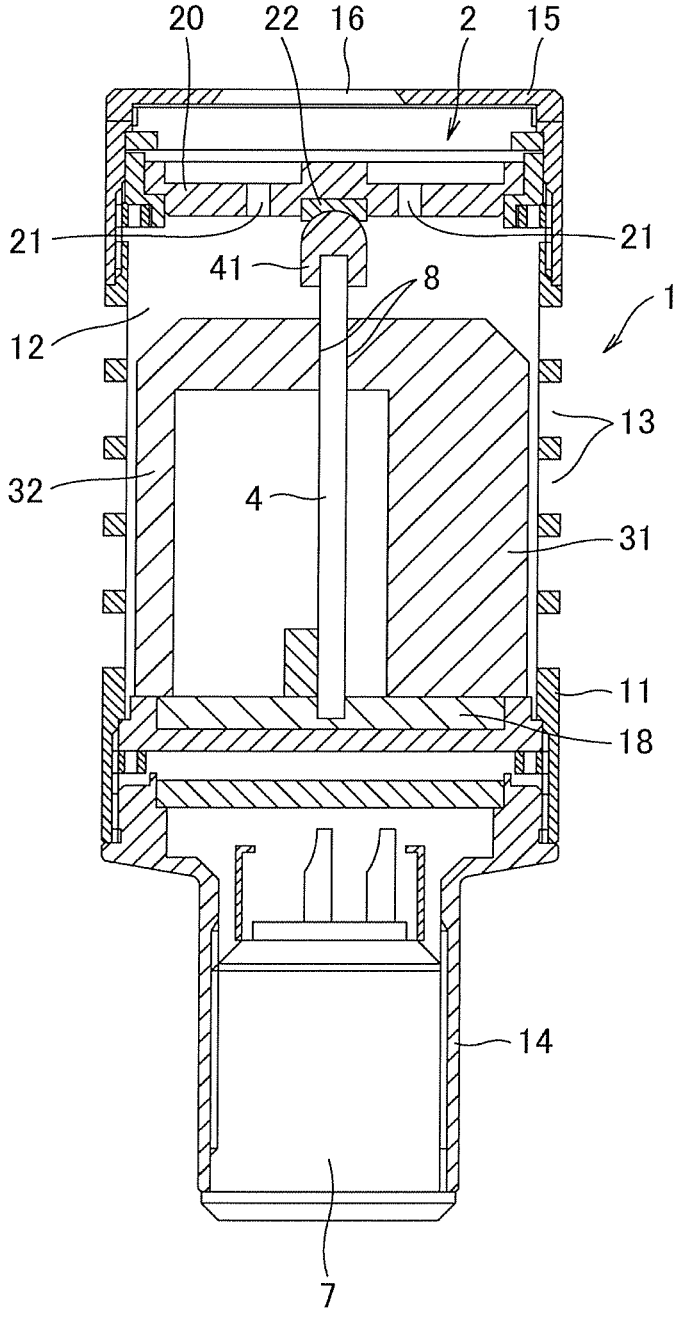
FIG. 1 is a longitudinal cross-sectional view illustrating a condenser microphone according to an embodiment of the present invention.
Figure 2:
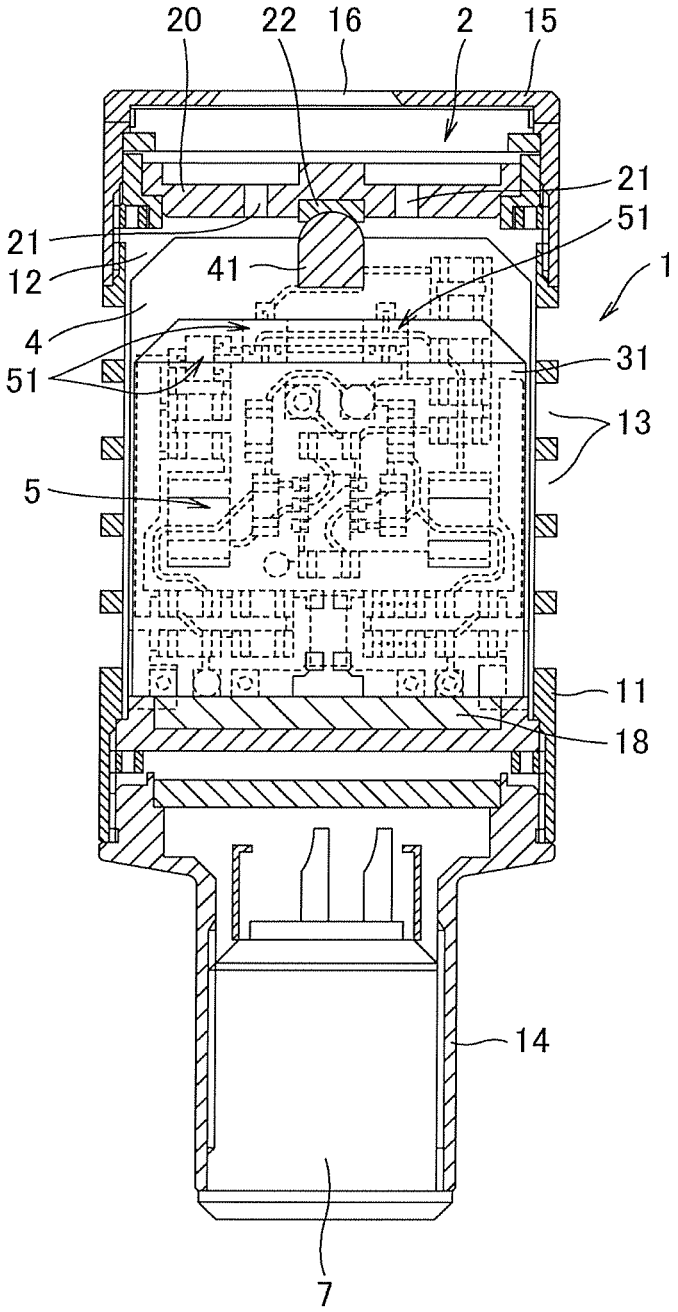
FIG. 2 is a longitudinal cross-sectional view perpendicular to that of FIG. 1.

In FIGS. 1 and 2, a microphone case 1 includes a cylindrical segment 11 that is a main side wall thereof, a head segment 15 that is a cap for the front mouth of the cylindrical segment 11, and a connector segment 14 coupled with the rear mouth of the cylindrical segment 11. The cylindrical segment 11 has an internal space 12, and accommodates a condenser microphone unit 2 at the front therein. The condenser microphone unit 2 has unidirectionality. The cylindrical segment 11 has an appropriate number of openings 13 such that the space 12 inside the cylindrical segment 11 communicates with the openings 13 and is open to the exterior of the microphone through the openings 13.

As is well known, the condenser microphone unit 2 includes a diaphragm vibrating in response to sound waves and a counter electrode 20 fixed opposite to the diaphragm with a minute interval. The diaphragm and the counter electrode 20 define a capacitor. Vibration of the diaphragm is electro-acoustically converted into a variation in the capacitance of the capacitor. The head segment 15 has an opening 16 that introduces sound waves to the condenser microphone unit 2 and that functions as a front acoustic terminal. The counter electrode 20 has an appropriate number of through holes across the thickness of the counter electrode 20 to allow a space behind the diaphragm to communicate with the exterior of the condenser microphone unit 2. The through holes function as rear acoustic terminals 21. The space 12 inside the cylindrical segment 11 communicates with the rear acoustic terminals 21 and the openings 13.

The space 12 inside the cylindrical segment 11 contains volume restrictors 31 and 32 for reducing the volume of the space 12. That is, the volume restrictor consists of two separate volume restrictors 31 and 32. The volume restrictors 31 and 32 have such a volume that occupies most of the space 12, and are shaped and sized so as not to block the openings 13 of the cylindrical segment 11.

The space 12 inside the cylindrical segment 11 further contains a circuit board 4 having an electronic circuit 5 thereon. One end of the circuit board 4 (the lower end in FIGS. 1 and 2) is held by a base 18 tightly fitting within the rear end of the cylindrical segment 11. The other end of the circuit board 4 (the upper end in FIGS. 1 and 2) is pinched by a conductive holder 41, and is held by urging force onto the holder 41 against an electrode member 22 embedded in the center of the counter electrode 20. With the both ends held by the above-described holding structures, the circuit board 4 is disposed at the center of the cylindrical segment 11 and in parallel with the central axis of the cylindrical segment 11.

The electronic circuit 5 (see FIG. 2) mounted on the circuit board 4 processes signals output from the condenser microphone unit 2 into microphone output signals for output. In more specific, the electronic circuit 5 includes a FET 51 to convert the output impedance of the condenser microphone unit 2. The electronic circuit 5 may further include an optional element such as a buffer amplifier or a signal processing circuit for balanced output. The counter electrode 20 functions as one of the electrodes for outputting signals of the condenser microphone unit 2, and is electrically connected, via the electrode member 22 and the holder 41, to a predetermined circuit pattern on the circuit board 4. The diaphragm functions as the other electrode for outputting signals of the condenser microphone unit 2. Furthermore, the diaphragm is electrically connected, via components such as a microphone unit case and the microphone case 1, with a predetermined circuit pattern on the circuit board 4.

The volume restrictors 31 and 32 sandwich or encompass the circuit board 4 therebetween. The volume restrictors 31 and 32 each have a concave on their facing surfaces. The electronic circuit 5 includes convex circuit elements, such as the FET 51, a resistance element, a capacitor, and a transformer. The concaves of the volume restrictors 31 and 32 define a room at least for the FET 51 among the circuit elements on the circuit board 4.

The rear ends of the volume restrictors 31 and 32 are fixed to the base 18. The volume restrictors 31 and 32 have adhesion surfaces 8 facing the circuit board 4 to be fixed to the circuit board 4, and are rigidly fixed inside the microphone case 1. The volume restrictors 31 and 32 not only reduce the volume of the space 12 but also block sound waves. In other words, the volume restrictors 31 and 32 also prevent sound waves entering the space 12 through the openings 13 from reaching the electronic circuit 5. The volume restrictors 31 and 32 are made of polycarbonate (PC) in the present embodiment, but may be made of any other equivalent material. The volume restrictors 31 and 32 each are a thick solid having a concave so as to block sound waves.

The volume restrictors 31 and 32 have the adhesion surfaces 8 facing the circuit board 4 to be fixed to the circuit board 4, so that sound waves from the exterior of the microphone are blocked before reaching the electronic circuit 5. If the adhesion surfaces 8 form any gap, which decreases the effect of blocking sound waves. The adhesion surfaces 8 therefore have a sealant for filling such a gap. The sealant further enhances the effect of blocking sound waves regardless of the gap on the adhesion surfaces 8.

The volume restrictors 31 and 32 are bonded to the circuit board 4 having the electrode circuit 5 while sandwiching the circuit board 4 therebetween, as described above. The volume restrictors 31 and 32 therefore prevent the circuit board 4 from vibrating in response to sound waves entering the microphone. In other words, the volume restrictors 31 and 32 also serve as a vibration suppressor for the circuit board 4.

The connector segment 14, which is coupled to the cylindrical segment 11 to constitute the microphone case 1, contains a connector 7. The connector 7 is connected with a cable connector provided at one end of a microphone cable such that signals output from the microphone are transmitted to external circuits through the microphone cable.

In the condenser microphone according to the above-described embodiment, the volume restrictors 31 and 32 occupy most of the volume of the space 12 communicating with the rear acoustic terminals 21 of the condenser microphone unit 2 inside the microphone case 1. The condenser microphone according to the embodiment thus reduces the volume of the space 12, reduces the resonance of the space 12, and shifts the resonance frequency toward a higher frequency even if the resonance occurs. The condenser microphone according to the embodiment can therefore provide excellent frequency response characteristics in a standard frequency range of sounds.

The volume restrictors 31 and 32 also prevent sound waves entering the space 12 through the openings 13 of the microphone case 1 from reaching the electronic circuit 5. Thus, even if sound waves with high acoustic pressure enter the space 12, the condenser microphone according to the embodiment can prevent such sound waves from reaching the electronic circuit 5. The condenser microphone according to the embodiment can therefore prevent the electronic circuit 5 from vibrating in response to sound waves with high acoustic pressure and eliminate incidental noise caused by the vibration of the electronic circuit 5, thereby achieving high sound quality.

The condenser microphone according to the present invention can acquire high-quality audio signals from sound waves with high acoustic pressure, and therefore is suitable for use near a loud instrument, in particular. The condenser microphone according to the present invention should however not be limited for use in loud sound and can be used under any conditions. With the condenser microphone according to the present invention, the sound quality does not deteriorate even if sound waves with high acoustic pressure enter the condenser microphone.

What is claimed is:

1. A condenser microphone comprising:

a condenser microphone unit comprising a rear acoustic terminal;

a microphone case accommodating the condenser microphone unit, the microphone case having a space therein, the space communicating with the rear acoustic terminal, the microphone case having openings on a side wall of the microphone case, the openings communicating with the space and the rear acoustic terminal;

a volume restrictor disposed in the space, the volume restrictor comprising two individual components; and a circuit board with an electronic circuit disposed in the space and sandwiched between the two individual components of the volume restrictor, wherein the volume restrictor reduces the volume of the space and prevents sound waves entering the space through the openings from reaching the electronic circuit.

2. The condenser microphone according to claim 1, wherein the electronic circuit outputs signals output from the condenser microphone unit as microphone output signals.

3. The condenser microphone according to claim 1, wherein the condenser microphone unit is a unidirectional microphone unit.

4. The condenser microphone according to claim 1, wherein the volume restrictor comprises polycarbonate.

5. The condenser microphone according to claim 1, wherein the volume restrictor is bonded to the circuit board.

6. The condenser microphone according to claim 1, wherein the volume restrictor prevents the circuit board from vibrating in response to sound waves.

7. The condenser microphone according to claim 5, wherein a sealant is embedded in a gap between adhesion surfaces of the volume restrictor and the circuit board.

8. The condenser microphone according to claim 1, wherein the two independent components of the volume restrictor are not in direct contact with one another.

9. A condenser microphone comprising:

a condenser microphone unit comprising a diaphragm, a rear acoustic terminal at a first side of the diaphragm, and a front acoustic terminal at a second side of the diaphragm, the first and second sides of the diaphragm being opposite one another;

a microphone case accommodating the condenser microphone unit, the microphone case having a space therein, the space communicating with the rear acoustic terminal, the microphone case having openings on a side wall of the microphone case, the openings communicating with the space;

a volume restrictor disposed in the space; and an electronic circuit disposed in the space and encompassed by the volume restrictor, wherein the volume restrictor reduces the volume of the space and prevents sound waves entering the space through the openings from reaching the electronic circuit, and the openings on the side wall and the front acoustic terminal communicate with an exterior of the condenser microphone at different locations.

* * * * *